US008090303B2

(12) United States Patent
Hayashi et al.

(10) Patent No.: US 8,090,303 B2
(45) Date of Patent: Jan. 3, 2012

(54) IMAGE FORMING APPARATUS

(75) Inventors: Masayuki Hayashi, Osaka (JP); Toshikane Nishii, Osaka (JP); Kohta Sakaya, Osaka (JP); Makoto Matsushita, Osaka (JP); Yoshitaka Sekiguchi, Hyogo (JP); Shunsuke Hamahashi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 482 days.

(21) Appl. No.: 12/396,819

(22) Filed: Mar. 3, 2009

(65) Prior Publication Data

US 2009/0238585 A1 Sep. 24, 2009

(30) Foreign Application Priority Data

Mar. 3, 2008 (JP) ..... 2008-051617
Mar. 2, 2009 (JP) ..... 2009-047875

(51) Int. Cl.
*G03G 15/00* (2006.01)
*G03G 15/16* (2006.01)
*G03G 15/01* (2006.01)

(52) U.S. Cl. ..... 399/301; 399/46; 399/49; 399/82; 399/85; 399/297; 399/298; 399/299; 399/300; 399/302

(58) Field of Classification Search ..... 399/46, 399/49, 82, 85, 297–302
See application file for complete search history.

(56) References Cited

U.S. PATENT DOCUMENTS

2006/0115303 A1* 6/2006 Kang et al. ..... 399/301
2007/0065200 A1* 3/2007 Asaba ..... 399/394
2008/0292335 A1* 11/2008 Kubota et al. ..... 399/39

FOREIGN PATENT DOCUMENTS

JP 2001-312116 11/2001
JP 2006-91141 4/2006
JP 2006-235560 9/2006
JP 2007-102189 4/2007

* cited by examiner

*Primary Examiner* — David Porta
*Assistant Examiner* — Mindy Vu
(74) *Attorney, Agent, or Firm* — Oblon, Spivak, McClelland, Maier & Neustadt, L.L.P.

(57) ABSTRACT

An image forming apparatus, forming a color image by successively superposing color images, formed on image carriers of corresponding image forming parts arranged along a rotational direction of an endless moving member, onto the endless moving member or a recording medium conveyed thereby, includes a first part causing a color registration pattern to be created on the endless moving member or the recording medium; a second part obtaining a color registration pattern signal by detecting the color registration pattern; a third part changing image formation timing in the image forming parts based on the color registration pattern signal; and a fourth part causing the endless moving member to rotate in forward and reverse directions after the creation of the color registration pattern. The second part obtains the color registration pattern signal by detecting the color registration pattern during each of the forward and reverse rotations of the endless moving member.

9 Claims, 10 Drawing Sheets

IMAGE FORMING APPARATUS

BACKGROUND OF THE INVENTION

1. Field of the Invention

The present invention relates generally to image forming apparatuses such as printers and copiers capable of forming color images, and more particularly to an image forming apparatus that performs color registration control on an endless moving member at the time of forming color images.

2. Description of the Related Art

As such image forming apparatuses as mentioned above, those are known that form a color image by successively transferring and superposing color images onto a transfer belt (also referred to as "intermediate transfer belt"), which is a single endless moving member, or a single recording medium (such as a sheet of paper) conveyed by a conveyor belt, where the color images are formed on the image carriers of corresponding image forming parts arranged side by side along the rotational direction of the conveyor belt.

Techniques related to color misregistration correction in such image forming apparatuses are described in, for example, Patent Documents 1 through 4 listed below. For example, Patent Document 1 describes reading a series of misregistration detection pattern images formed on a transfer belt (conveyor belt) with a pattern detection sensor using optical sensors formed of a specular reflection optical system, calculating the amount of misregistration between each adjacent two of color images based on the read pattern images, and correcting the positions of the images formed by corresponding image forming parts of colors other than a reference color based on the calculated amounts of misregistration.

[Patent Document 1] Japanese Laid-Open Patent Application No. 2001-312116

[Patent Document 2] Japanese Laid-Open Patent Application No. 2007-102189

[Patent Document 3] Japanese Laid-Open Patent Application No. 2006-235560

[Patent Document 4] Japanese Laid-Open Patent Application No. 2006-091141

However, according to the image forming apparatus described in Patent Document 1, the spot positions of specular reflection and diffuse reflection are offset relative to each other for various reasons in the pattern detection sensors, so that it is difficult to calculate an accurate center position from a pattern detection signal because of the effect of diffuse reflection light that enters the optical sensors together with specular reflection light. The resultant detection error has more than a small effect on the accuracy of color registration, thus preventing improvement in the accuracy of color registration.

Patent Document 2 describes a method of determining abnormality in the amount of correction based on a detected amount of color misregistration or setting fixed values at the time of adjustments in a factory, and is not related to control of reading color registration patterns.

The technique described in Patent Document 3 is for preventing a decrease in the accuracy of color misregistration detection due to variations in speed caused by variations in the thickness of a belt, and does not prevent a decrease in the accuracy of color misregistration detection due to sensor reading error.

The technique described in Patent Document 4 is related to correcting an error in color misregistration calculation in an easy and simplified manner in accordance with an environment of usage such as a temperature or humidity at the time, and is not related to control of reading color registration patterns.

SUMMARY OF THE INVENTION

According to one aspect of the present invention, an image forming apparatus is provided that is improved in the accuracy of color registration on an endless moving member in forming a color image.

According to one embodiment of the present invention, an image forming apparatus, configured to form a color image by successively superposing images of respective colors, formed on image carriers of corresponding image forming parts arranged side by side along a rotational direction of a single endless moving member, onto one of the endless moving member and a recording medium conveyed thereby, includes a pattern image creating part configured to cause a color registration pattern to be created on the one of the endless moving member and the recording medium; a color registration pattern detecting part configured to obtain a color registration pattern signal by detecting the created color registration pattern; an image formation timing varying part configured to change image formation timing in the image forming parts based on the obtained color registration pattern signal; and a control part configured to cause the endless moving member to rotate in a forward direction and a reverse direction after the creation of the color registration pattern, wherein the color registration pattern detecting part is configured to obtain the color registration pattern signal by detecting the color registration pattern during each of the forward rotation and the reverse rotation of the endless moving member.

According to one aspect of the present invention, it is possible to improve the accuracy of color registration on an endless moving member in the case of forming a color image.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given below, with reference to the accompanying drawings, of embodiments of the present invention.

Figure 1:
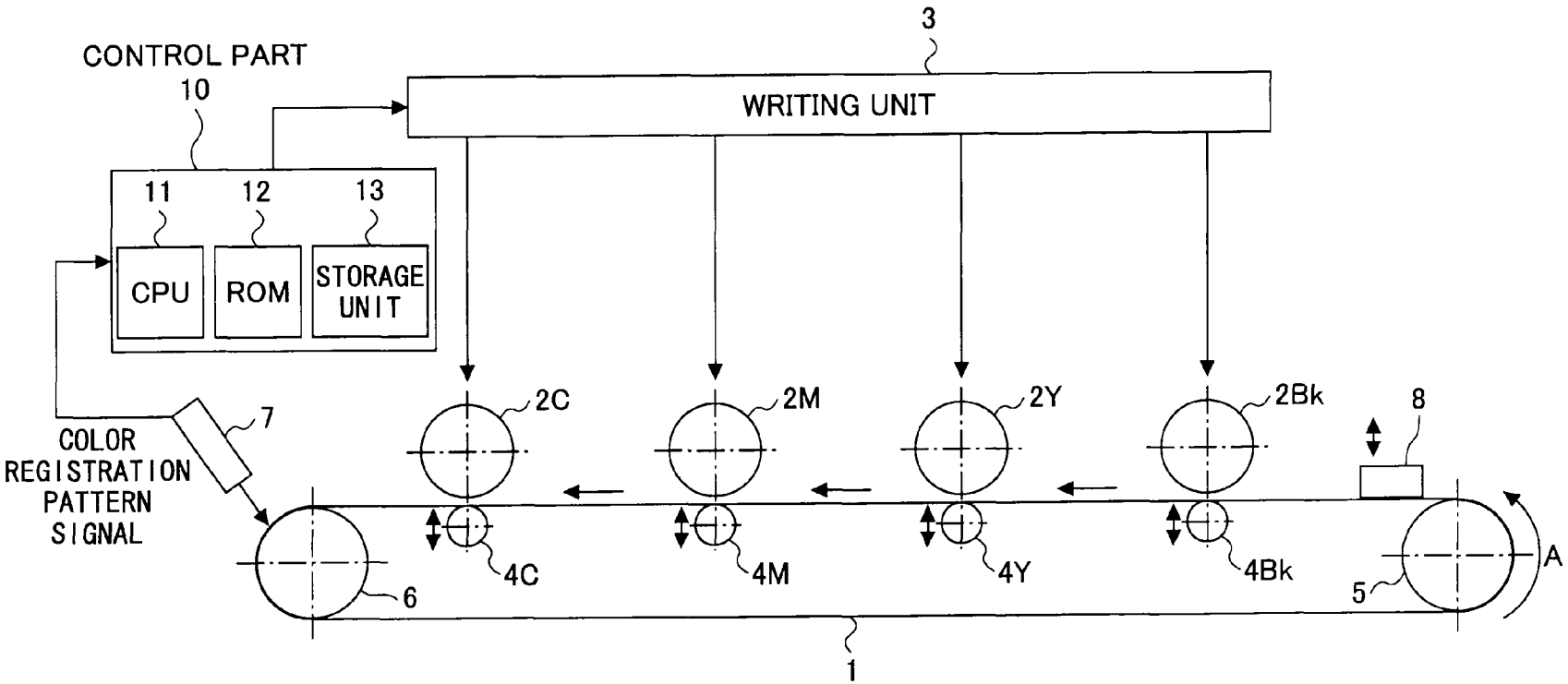
FIG. 1 is a schematic diagram illustrating an image forming apparatus according to an embodiment of the present invention.

First, a description is given, with reference to FIG. 1, of a general configuration and an image forming operation of an image forming apparatus to which the present invention is applied.

FIG. 1 is a schematic diagram illustrating the image forming apparatus.

For example, as illustrated in FIG. 1, the image forming apparatus is a tandem laser printer where multiple image forming parts are arranged side by side with a writing unit 3 along a rotational direction of a transfer belt (intermediate transfer belt) 1, which is a single endless moving member.

The image forming parts include respective drum-shaped photosensitive bodies 2 (2Bk, 2Y, 2M, and 2C) as image carriers for forming images with black (Bk) toner, yellow (Y) toner, magenta (M) toner, and cyan (C) toner, respectively, and respective toner cartridges (not graphically illustrated). The photosensitive bodies 2 and the corresponding toner cartridges are integrated.

The image forming apparatus may be other types of image forming apparatuses such as a copier, a multifunctional machine, and a facsimile machine.

According to this image forming apparatus, single-color toner images of different colors of Bk, Y, M, and C are formed on the corresponding photosensitive bodies 2. Transfer belt contact/separation mechanisms including a motor (not graphically illustrated) are caused to operate to bring corresponding transfer rollers 4 (4Bk, 4Y, 4M, and 4C) into contact with the transfer belt 1, thereby bringing the transfer belt 1 into contact with the photosensitive bodies 2 (2Bk, 2Y, 2M, and 2C). As a result, the single-color toner images on the peripheral surfaces of the photosensitive bodies 2 are successively transferred onto the transfer belt 1 in a superposed manner. The superposed color images are simultaneously transferred onto a recording medium such as a sheet of paper, thereby forming a full-color image.

According to the transfer belt contact/separation mechanisms, a transfer position on the peripheral (outside) surface of the transfer belt 1 and the peripheral surface of the corresponding photosensitive body 2 are selectively caused to be in contact or out of contact (separated) by selectively causing the corresponding transfer roller 4 to move up or down by turning the pushing-up member of the corresponding transfer belt contact/separation mechanism in a counterclockwise or clockwise direction around a spindle.

The image forming apparatus further includes a cleaner part 8 and a cleaner part contact/separation mechanism (not graphically illustrated). The cleaner part 8 cleans the peripheral surface of the transfer belt 1 (removes toner remaining on the transfer belt 1 and delivers the removed toner into a collecting tank as waste toner) before image formation. The cleaner part contact/separation mechanism causes the cleaner part 8 to move up or down to cause the peripheral surface of the transfer belt 1 and the blade of the cleaner part 8 (for scraping up residual [remaining] toner) to be in contact or out of contact (separated). By moving the cleaner part contact/separation mechanism, that is, by selectively turning the pushing-up member of the cleaner part contact/separation mechanism in a counterclockwise or clockwise direction around a spindle, the cleaner part 8 is moved up or down to cause the blade of the cleaner part 8 and the peripheral surface of the transfer belt 1 to be out of contact (separated) or in contact.

In the image forming apparatus having the above-described configuration, the laser light emitted from each laser diode (LD) in the writing unit 3 is deflected by a rotating polygon mirror (hereinafter referred to as "polygon mirror") to travel through an fθ lens to perform scanning and writing on the precharged surface of the corresponding photosensitive body 2, so that an electrostatic latent image (electrostatic image) is formed on the surface of the corresponding photosensitive body 2 exposed to the laser light. At this point, each LD is modulated and driven (turned on and off) based on an image signal fed from a control part 10 to emit laser light, and the laser light is caused to perform scanning repeatedly in the main scanning direction in accordance with the rotation of the polygon mirror, while the corresponding photosensitive body 2 rotates to cause the laser light to move in the sub scanning direction. As a result, an electrostatic latent image is formed on the photosensitive body 2.

The electrostatic latent images formed on the photosensitive bodies 2 are developed with charged toner (developing agent) into toner images, and the transfer belt 1, provided with an electric charge opposite in polarity to that of the toner, is caused to adhere closely to the peripheral surface of the photosensitive body 2. As a result, the toner images are successively transferred and superposed onto the transfer belt 1 to form a color image. After separation from the photosensitive bodies 2, the transfer belt 1 is caused to adhere closely to a recording medium fed from a paper feed part (not graphically illustrated), so that the color image is transferred onto the recording medium. After separation from the transfer belt 1, the recording medium is heated with a fuser (fixing unit) (not graphically illustrated), so that the color image is fused and fixed onto the recording medium.

As illustrated in FIG. 1, the image forming apparatus includes a pattern detection sensor 7. The pattern detection sensor 7 employs an optical sensor composed of a light-emitting element and a light-receiving element. The pattern detection sensor 7, which is used to detect the misregistration (deviation from an ideal position) of each of electrostatic latent images of respective colors formed on the photosensitive bodies 2, reads color registration patterns for misregistration detection, and detects the amount of misregistration from an obtained color registration pattern signal. The control part 10 feeds the detection result back to the writing unit 3, thereby controlling (varying) the lighting timing of each LD (the timing of forming an image on the corresponding photosensitive body 2) and correcting misregistration. As a result, it is possible to form a color image with better quality.

As illustrated in FIG. 1, the transfer belt 1 is an endless belt wound around a drive roller 5 and driven roller 6.

The drive roller 5 is rotated by a drive motor (not graphically illustrated). Accordingly, the drive roller 5, in combination with the drive motor and the driven roller 6, serves as a drive part (rotation mechanism) to rotate (move) the transfer belt 1 in a forward direction and a reverse (backward) direction as described below.

Usually, the transfer belt 1 is rotated in a direction indicated by arrow A in FIG. 1 (hereinafter referred to as "forward direction"), so that toner images on the photosensitive bodies 2 are successively transferred and superposed onto the transfer belt 1, thereby forming a color image.

The control part 10 employs a microcomputer including a central processing unit (CPU) 11, a ROM 12, and a storage part 13. The CPU 11 executes programs. The ROM 12 contains fixed data including the programs. The storage part 13 includes a RAM and a nonvolatile memory for storing various data items. The control part 10 controls the image forming apparatus including the writing unit 3, the pattern detection sensor 7, the drive motor, the transfer belt contact/separation mechanisms, and the cleaner part contact/separation mechanism. Thereby, the control part 10 implements functions as a color image forming part, a monochrome image forming part, a color registration pattern image creating part, a color registration pattern detecting part, a correction calculating part, a pattern center position calculating part, an image formation timing varying part, a control part, a control mode selecting part, an inside temperature detecting part, and a level control part according to the embodiment of the present invention. The CPU 11 may execute a program to cause the control part 10 to implement the above-described parts. Further, the storage part 13 implements functions as a correction storage part, a rotation number storage part, and an inside temperature storage part.

Next, a description is given of embodiments of the image forming apparatus to which the present invention is applied.

First Embodiment

First, a description is given of a first embodiment.

Figure 2:
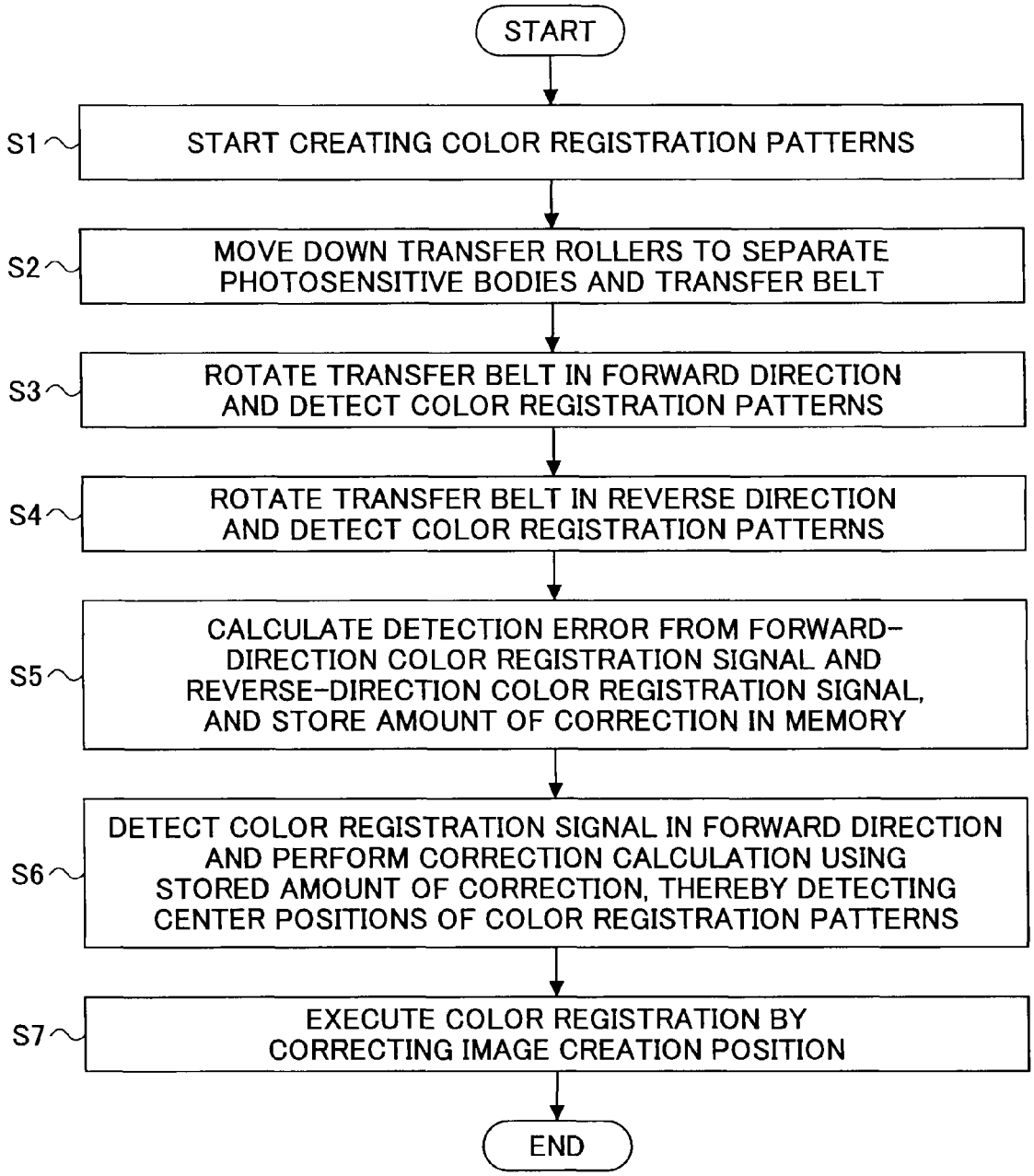
FIG. 2 is a flowchart illustrating color registration control by a control part of FIG. 1 according to a first embodiment of the image forming apparatus of the present invention.

FIG. 2 is a flowchart illustrating color registration control by the control part 10 of the image forming apparatus illustrated in FIG. 1.

In the case of performing printing only in black in forming an image, the control part 10 causes the corresponding transfer belt contact/separation mechanisms to withdraw the transfer roller 4Y, 4M, and 4C to separate the corresponding photosensitive bodies 2 from the transfer belt 1, thereby causing the above-described image formation process to be performed only for black color.

Figure 3:
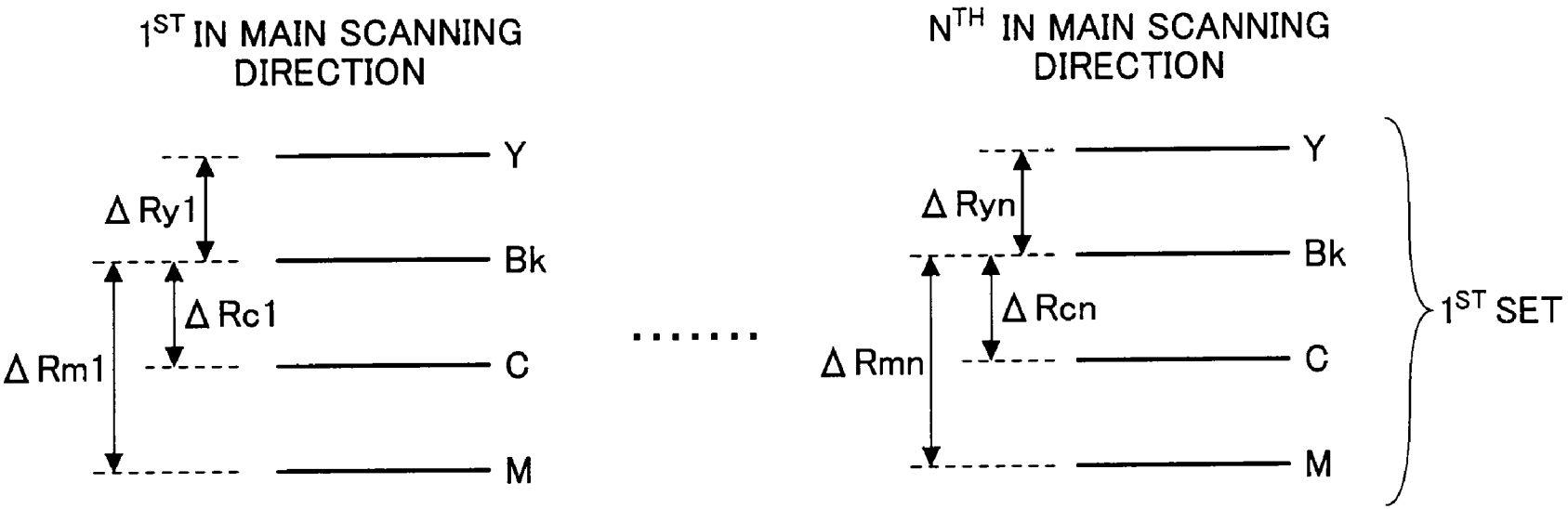
FIG. 3 is a diagram illustrating color registration patterns created on a transfer belt of FIG. 1 according to the first embodiment of the image forming apparatus of the present invention.

First, in step S1, the control part 10, serving as a color registration pattern image creating part, controls the writing unit 3 and the image forming parts to start creating (forming) (the images of) color registration patterns on the photosensitive bodies 2. Next, in step S2, in response to completion of creating the color registration patterns of all colors, the color registration patterns are transferred onto the transfer belt 1 as illustrated in FIG. 3. Thereafter, the transfer belt contact/separation mechanisms are caused to move down (withdraw) the transfer rollers 4 to separate the photosensitive bodies 2 from the transfer belt 1. FIG. 3 illustrates the case of creating n (n columns of) color registration patterns in the main scanning direction (n is an integer greater than zero).

Then, in step S3, after separation of the photosensitive bodies 2 and the corresponding transfer rollers 4, the control part 10, serving as a pattern detecting part, causes the transfer belt 1 to rotate in the forward direction, and controls the pattern detection sensor 7 to detect the color registration patterns on the transfer belt 1, thereby obtaining a color registration pattern signal (forward [forward-direction] color registration pattern signal) from the pattern detection sensor 7. At this point, the transfer belt 1 is caused to rotate in the forward direction until all the color registration patterns are detected by the pattern detection sensor 7, that is, up to a position where all the color registration patterns have been detected by the pattern detection sensor 7.

Thereafter, in step S4, the control part 10 causes the transfer belt 1 to rotate in the direction opposite the direction indicated by arrow A (hereinafter referred to as "reverse direction"), and causes the pattern detection sensor 7 to again detect the color registration patterns that have been detected to obtain the forward color registration pattern signal, thereby obtaining a color registration pattern signal (reverse [reverse-direction] color registration pattern signal). At this point, the transfer belt 1 is caused to rotate in the reverse direction until all the color registration patterns are detected by the pattern detection sensor 7, that is, up to a position where all the color registration patterns have been detected by the pattern detection sensor 7. That is, in the processing of step S3 and step S4, the color registration patterns are detected from each of the transfer belt 1 rotating in the forward direction and the transfer belt 1 rotating in the reverse direction, thereby obtaining (generating) respective color registration pattern signals.

Then, in step S5, a detection error included in the obtained color registration pattern signals (hereinafter referred to as "color registration pattern signal pair") is calculated. Further, color misregistration is corrected using the calculated detection error.

Figure 4:
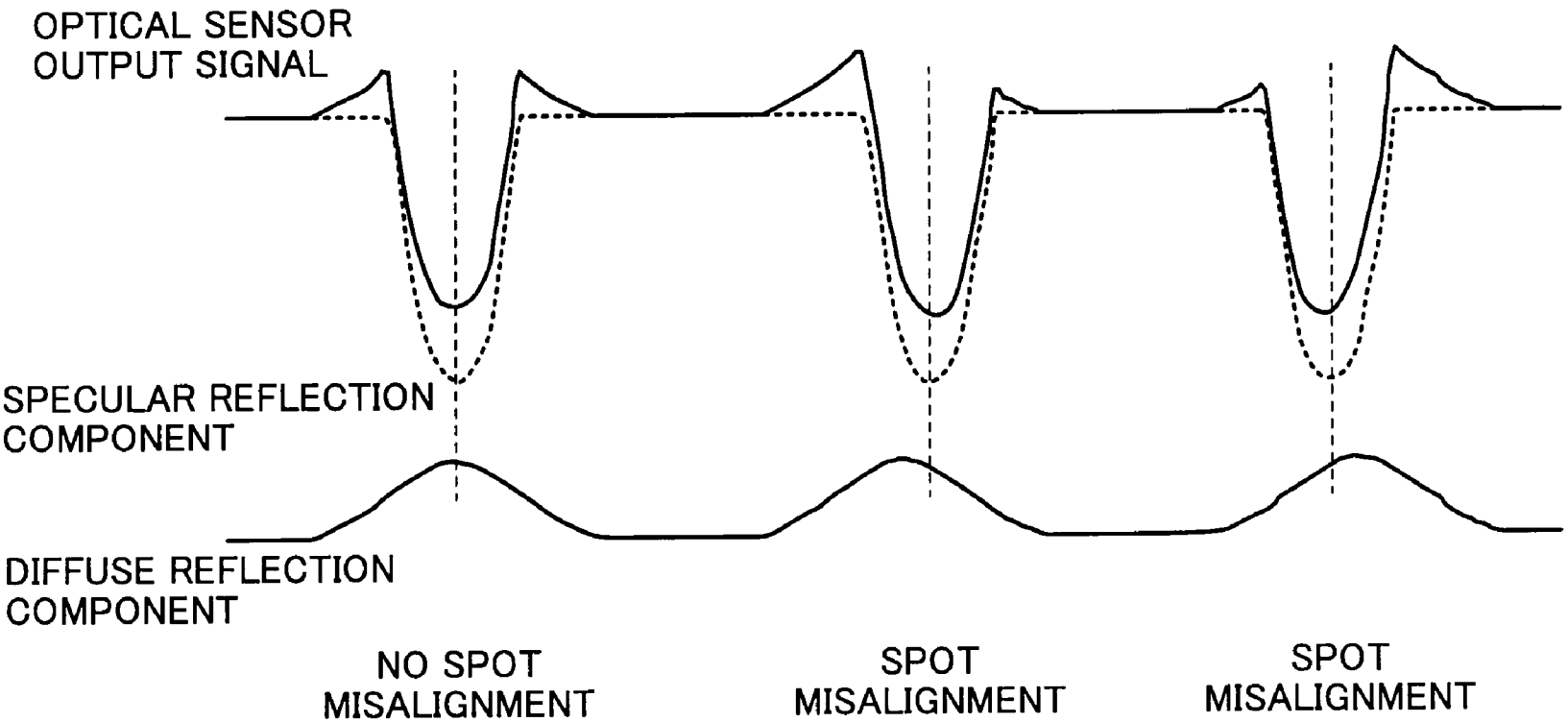
FIG. 4 is a diagram illustrating examples of the waveform of a color registration pattern signal output by a pattern detection sensor of FIG. 1 according to the first embodiment of the image forming apparatus of the present invention.
Figure 5:
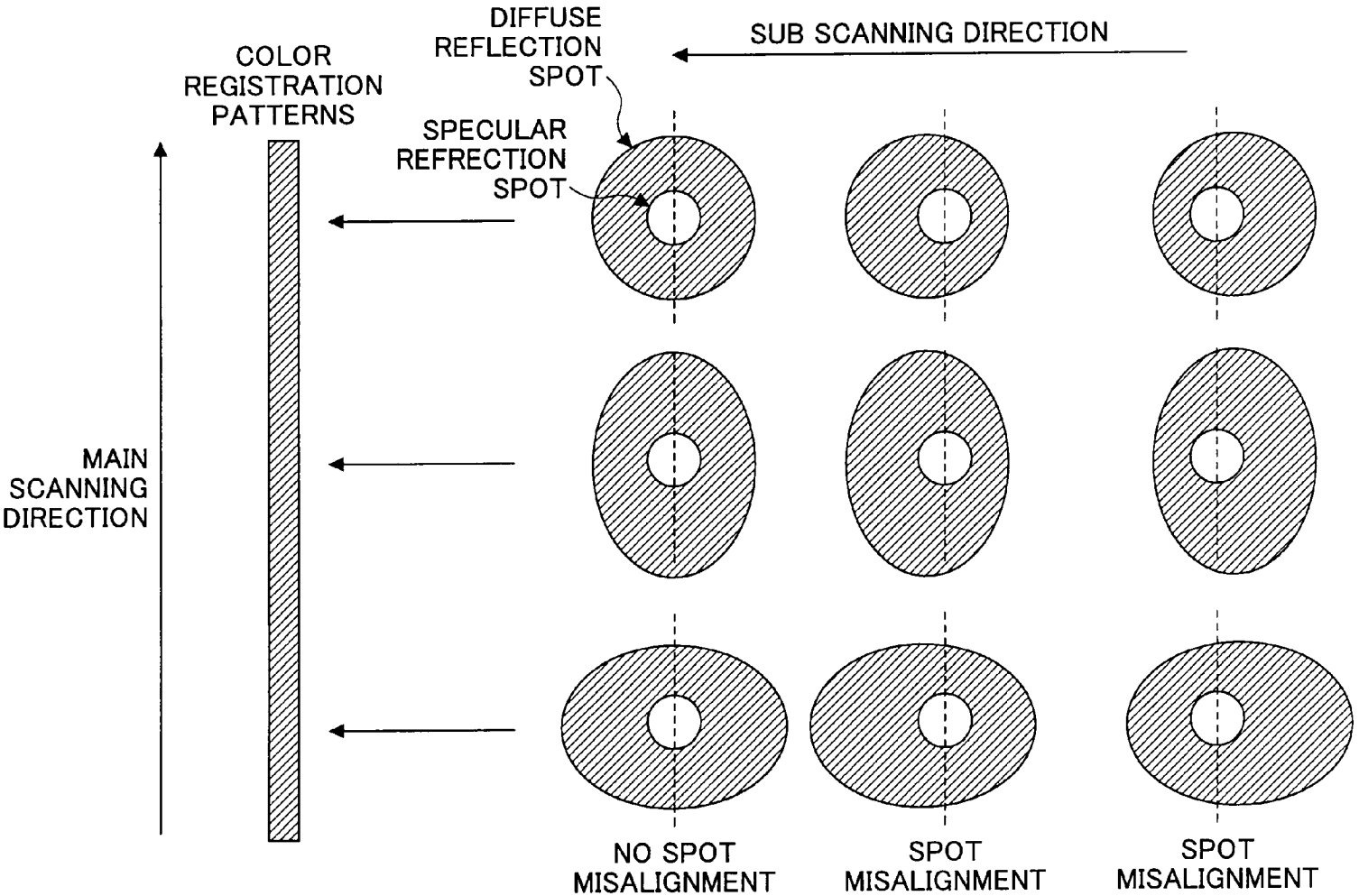
FIG. 5 is a diagram for illustrating the misalignment of a specular reflection spot and a diffuse reflection spot in the pattern detection sensor of FIG. 1 according to the first embodiment of the image forming apparatus of the present invention.

Here, an error in detecting a color registration pattern signal due to misalignment of a specular reflection spot and a diffuse reflection spot resulting from variations in focal length, tilt/shift, or skew caused by various error factors as illustrated in, for example, FIG. 4 or FIG. 5, is defined as a detection error included in a color registration pattern signal. In other words, the detection error included in a color registration signal is an error due to the effect of diffuse reflection light due to the optical axis misalignment or attachment error of the sensor. In the case of a distorted diffuse reflection spot, there is no error as long as the center of the diffuse reflection spot coincides with the center of the specular reflection spot in the main scanning direction.

In the image forming apparatus to which the present invention is applied, Bk (black) is not affected by diffuse reflection light. Therefore, the CPU 11 of the control part 10 calculates the difference between the center position of Bk and the center position of each of Y (yellow), C (cyan), and M (magenta). The color registration pattern signal varies at an edge of the color registration pattern. Accordingly, the center of the positional variation of the color registration pattern signal is detected as the center position of the color registration pattern. A detailed description of color registration pattern detection, which is known art, is omitted.

Here, referring to FIG. 3, the difference between a color registration pattern Bk and a color registration pattern Y transferred onto the transfer belt 1 is defined as $\Delta Ry$. Likewise, the difference between color registration patterns Bk and C is defined as ΔRc, and the difference between color registration patterns Bk and M is defined as ΔRm.

Further, an error in detecting a color registration pattern signal caused by other than the positional deviation of the pattern detection sensor 7 is defined as the amount of color misregistration included in the detected pattern signal. The amount of color misregistration between Bk and Y included in the detected pattern signal is defined as Δy, the amount of color misregistration between Bk and C included in the detected pattern signal is defined as Δc, and the amount of color misregistration between Bk and M included in the detected pattern signal is defined as Δm. The amount of color misregistration included in the detected pattern signal results from positional deviations or optical factors in configurations other than the pattern detection sensor 7.

Further, the above-defined detection error of Y with reference to Bk is defined as ΔZy, the above-defined detection error of C with reference to Bk is defined as ΔZc, and the above-defined detection error of M with reference to Bk is defined as ΔZm.

Further, the difference between the center position of Bk and the center position of Y, the difference between the center position of Bk and the center position of C, and the difference between the center position of Bk and the center position of M in the forward color registration pattern signal are defined as ΔRy+, ΔRc+, and ΔRm+, respectively.

Further, the difference between the center position of Bk and the center position of Y, the difference between the center position of Bk and the center position of C, and the difference between the center position of Bk and the center position of M in the reverse color registration pattern signal are defined as ΔRy−, ΔRc−, and ΔRm−, respectively.

Here, the forward color registration pattern signal and the reverse color registration pattern signal have the relationship represented by the following equations. The following equations are based on the fact that the value of the amount of color misregistration (Δn) is the same in the forward direction and the reverse direction and that the absolute value of the detection error (ΔZn) is the same in the forward direction and the reverse direction but the detection error (ΔZn) changes in value depending on the belt conveyance direction (forward direction or reverse direction). The detection error (ΔZn) is an error that appears in the detection result because of the misalignment of the center positions of the diffuse reflection spot and the specular reflection spot due to their misalignment as illustrated in FIG. 5.

$$\Delta Ry+=\Delta Ry+\Delta y+\Delta Zy \quad (1)$$

$$\Delta Rc+=\Delta Rc+\Delta c+\Delta Zc \quad (2)$$

$$\Delta Rm+=\Delta Rm+\Delta m+\Delta Zm \quad (3)$$

$$\Delta Ry-=\Delta Ry+\Delta y-\Delta Zy \quad (4)$$

$$\Delta Rc-=\Delta Rc+\Delta c-\Delta Zc \quad (5)$$

$$\Delta Rm-=\Delta Rm+\Delta m-\Delta Zm \quad (6)$$

Accordingly, from Equations (1) and (4), from Equations (2) and (5), and from Equations (3) and (6), the detection error of each color with reference to Bk is given by:

$$\Delta Zy=(\Delta Ry+-\Delta Ry-)/2 \quad (7)$$

$$\Delta Zc=(\Delta Rc+-\Delta Rc-)/2 \quad (8)$$

$$\Delta Zm=(\Delta Rm+-\Delta Rm-)/2 \quad (9)$$

Here, ΔZy, ΔZc, and ΔZm are the center position errors of the respective colors with reference to the center position of Bk, and the average of the values determined by Equations (7), (8), and (9) is defined as the detection error of the color registration pattern signals as follows:

$$\Delta Z=(\Delta Zy+\Delta Zc+\Delta Zm)/3 \quad (10)$$

The CPU 11 of the control part 10 stores the detection error of the color registration pattern signals given by Equation (10), that is, the detection error calculated based on the values of the difference between the color registration pattern signals, in the storage part 13 (nonvolatile memory) as the amount of detection error correction (the amount of correction for correcting the detection error).

Next, in step S6, the transfer belt 1 is caused to rotate in the forward direction as in step S3, and the pattern detection sensor 7 is caused to detect the color registration patterns on the transfer belt 1, thereby obtaining a forward color registration pattern signal from the pattern detection sensor 7 (detecting a color registration pattern signal in the forward direction). Then, the obtained forward color registration pattern signal is subjected to correction calculation using the amount of detection error correction contained in the storage part 13, thereby calculating (detecting) the center positions of the color registration patterns. The forward color registration pattern signal obtained in step S3 may be subjected to correction calculation using the amount of detection error correction contained in the storage part 13. In this case, the pattern detection sensor 7 does not have to newly detect the color registration patterns on the transfer belt 1.

Finally, in step S7, color registration is performed based on the calculated center positions of the color registration patterns (correction of image creating positions), and the timing of image creation (image formation) on each photosensitive body 2 is changed.

Further, calculation of the amount of detection error correction by detecting color registration pattern signals may be performed only at the time of turning on power, the color registration patterns may be detected only in the forward direction without separating the photosensitive bodies 2 and the transfer belt 1 at the time of their detection after the calculation of the amount of detection error correction, and correction calculation may be performed by calling the amount of detection error correction from the storage part 13 at the time of calculating the center positions of the color registration patterns. In this case, there is no need to cause the photosensitive bodies 2 and the transfer belt 1 to be in contact or out of contact (separated) or to detect the color registration patterns by rotating the transfer belt 1 in the reverse direction in every color registration pattern signal detection (that is, in every color registration control).

Figure 6:
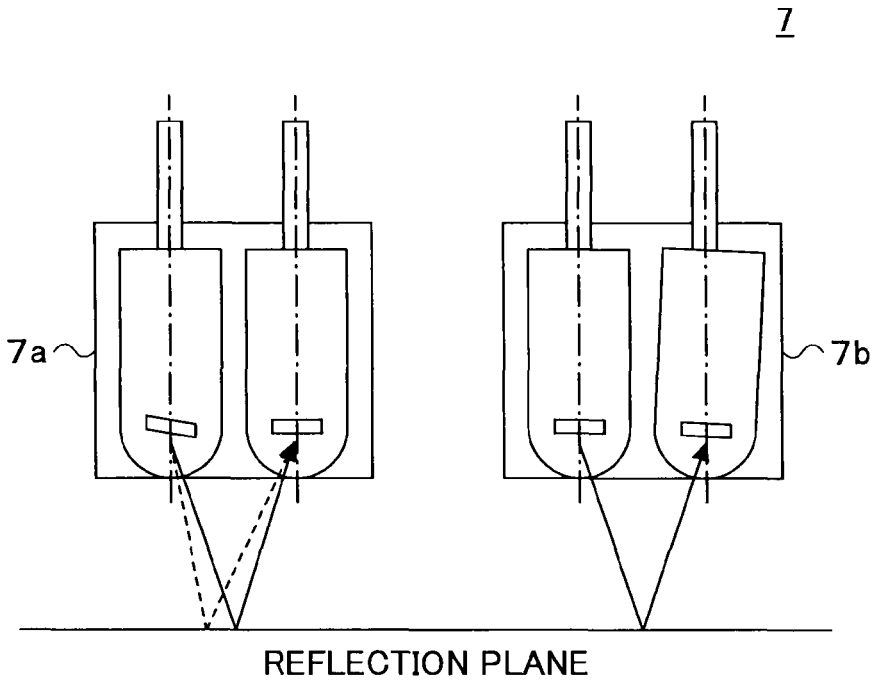
FIG. 6 is a cross-sectional view of optical sensors in the pattern detection sensor of FIG. 1 for illustrating variations in the optical sensors according to the first embodiment of the image forming apparatus of the present invention.
Figure 7:
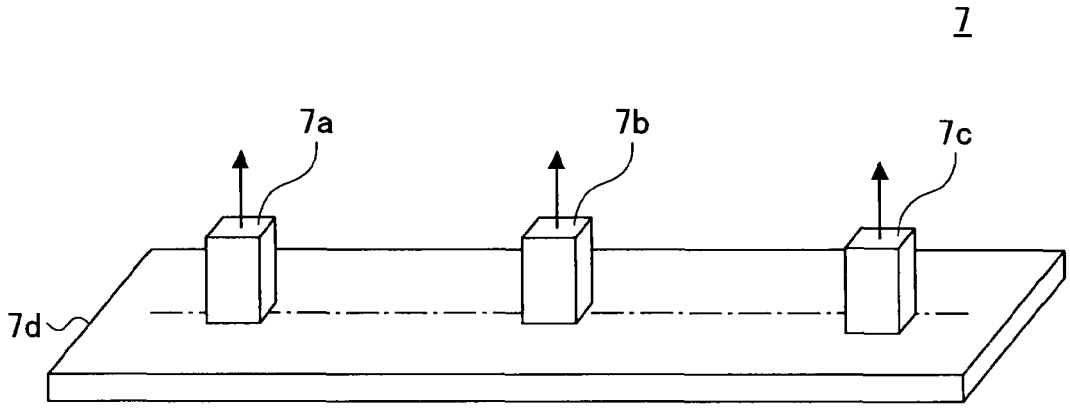
FIG. 7 is a perspective view for illustrating variations in the positions of attachment of the optical sensors to a substrate in the sensor unit of the pattern detection sensor 7 of FIG. 1 according to the first embodiment of the image forming apparatus of the present invention.
Figure 8:
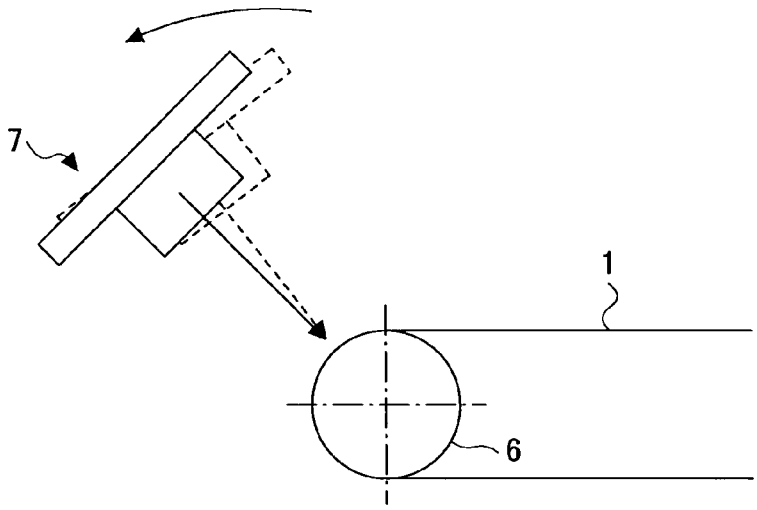
FIG. 8 is a cross-sectional view for illustrating a variation in the position of attachment of the sensor unit of the pattern detection sensor 7 of FIG. 1 to an apparatus body according to the first embodiment of the image forming apparatus of the present invention.
Figure 9:
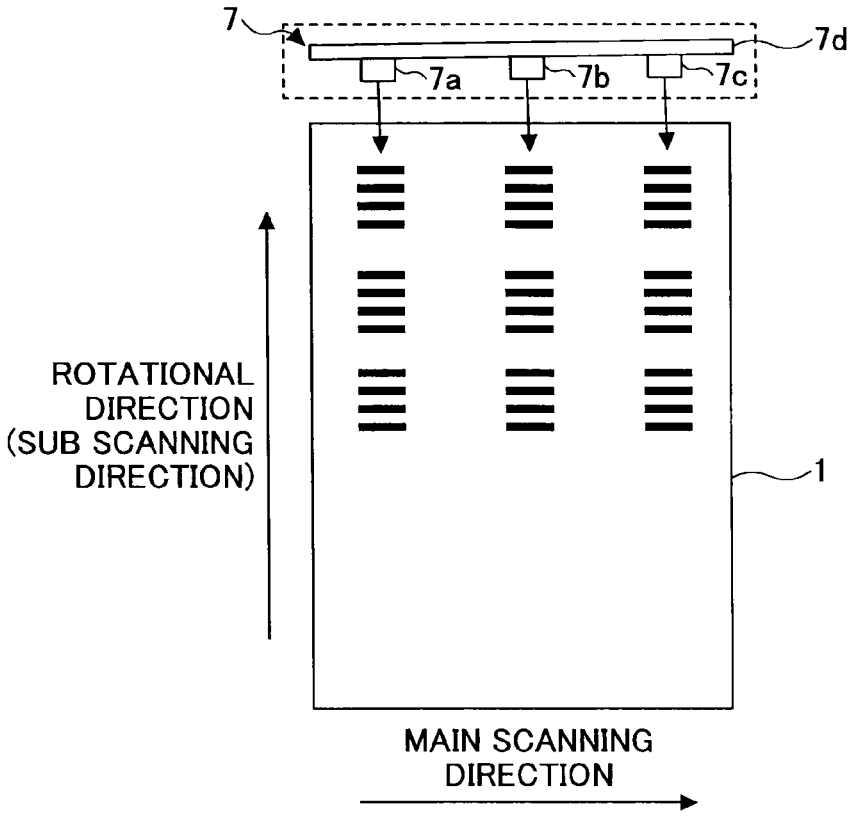
FIG. 9 is a top plan view for illustrating the variation in the position of attachment according to the first embodiment of the image forming apparatus of the present invention.
Figure 10:
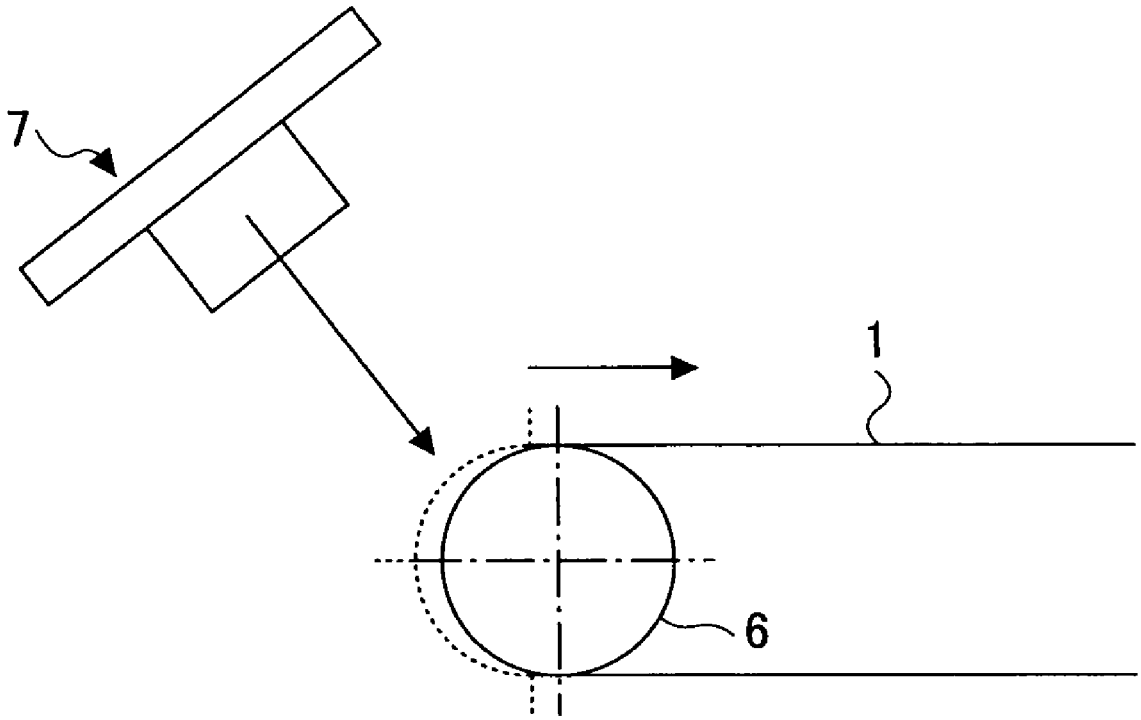
FIG. 10 is a cross-sectional view for illustrating a variation in the position of attachment of the transfer belt of FIG. 1 to the apparatus body according to the first embodiment of the image forming apparatus of the present invention.

The above-described color registration control of the first embodiment is effective in correcting color misregistration in the sub scanning direction due to, for example, (i) a variation in optical sensors of the pattern detection sensor 7 due to their own variation factors such as the displacement of the lead frame of a light-emitting or light-receiving element or the bonding error of a light-emitting or light-receiving element at the time of die bonding as illustrated in an optical sensor 7*a* of FIG. 6, and a displacement due to the optical shape of a case as illustrated in an optical sensor 7*b* of FIG. 6; (ii) a variation in the positions of attachment of optical sensors to a board or substrate in the sensor unit of the pattern detection sensor 7 due to, for example, the deviation of the position of attachment) of an optical sensor 7*c* to a substrate 7*d* as illustrated in FIG. 7 (showing an example of three optical sensors); (iii) a variation in the position of attachment of the pattern detection sensor 7 (sensor unit) to the body of the image forming apparatus as illustrated in FIG. 8 or FIG. 9; or (iv) a variation in the position of attachment of the transfer belt 1 to the body of the image forming apparatus as illustrated in FIG. 10.

Thus, according to the first embodiment, in color registration control performed by creating color registration patterns in order to correct color misregistration of created patterns due to a mechanically caused positional deviation of an image forming part of the image forming apparatus, the color registration patterns are detected in both the forward direction and the reverse direction using a pattern detection sensor, thereby calculating a detection error due to such factors as described below as (a) through (f), of which one or more may be included in an optical sensor (detection element) of the pattern detection sensor. As a result, the color registration control is performed with high accuracy in consideration of the detection error of the color registration patterns, so that it is possible to obtain a highly accurate color image.

(a) Optical sensor manufacture.

(b) Optical sensor type.

(c) Optical sensor lot.

(d) Variation in the positions of attachment of optical sensors.

(e) Position of attachment of a sensor unit including optical sensors to an apparatus body.

(f) Variation in the position of attachment of a transfer belt.

Further, this embodiment produces effects such as those described below as (A1) through (A7).

(A1) There are provided transfer belt contact/separation mechanisms for selectively causing photosensitive bodies to come into contact with or to be separated from a transfer belt and a rotation mechanism for causing the transfer belt to rotate in a forward or reverse direction. This makes it possible to facilitate detection of a color registration pattern signal pair for correcting the detection error of color registration patterns.

(A2) Separating all image forming parts and the transfer belt makes it possible to cause the transfer belt to rotate in the forward and reverse directions without imposing a load on units or components.

(A3) Storing a calculated amount of detection error correction in a storage part enables repeated use of the amount of detection error correction.

(A4) Controlling the amount of rotation of the transfer belt in accordance with the color registration patterns makes it possible to detect the color registration pattern signal pair in a shorter period of time.

(A5) After calculating the amount of detection error correction from the color registration pattern signal pair, the color registration patterns may be detected only in the forward direction, and the detection result may be corrected. In this case, there is no need to separate the photosensitive bodies and the transfer belt or to rotate the transfer belt in the reverse direction in every color registration control, so that it is possible to reduce time for color registration control.

(A6) Calculating a detection error with respect to each color from the color registration pattern signal pair and averaging the calculated detection errors make it possible to further increase the accuracy of color registration control.

(A7) At the time of color registration control after calculation of the amount of detection error correction (including its storage in the storage part), the center positions of the color registration patterns excluding the detection error of the color registration pattern signals may be calculated by performing correction calculation with a color registration pattern signal obtained by detecting the color registration patterns in the forward direction without separating the photosensitive bodies and the transfer belt and with the amount of detection error correction read from the storage part. In this case, it is possible to perform color registration control with high accuracy in a short period of time.

In the above-described case, the amount of misregistration of each of Y, C, and M is determined with reference to the position of Bk. Alternatively, however, Y, C, or M may be used as a reference. Further, the transfer belt 1 may be, but is not limited to, an intermediate transfer belt as described above using FIG. 1. In image forming apparatuses adopting a direct transfer system, the transfer belt 1 may be a conveyor belt that conveys a recording medium.

Second Embodiment

Next, a description is given of a second embodiment.

The detection error included in a color registration pattern signal changes after repeated use of the transfer belt 1.

Therefore, according to the second embodiment, the control part 10 causes the number of rotations of the transfer belt 1 (the number of times the transfer belt 1 is rotated) to be stored in the storage part 13, and performs color registration control including calculation (updating) of the amount of detection error correction and resets the number of rotations of the transfer belt 1 in the storage part 13 to zero (0) every time the stored number of rotations reaches a preset predetermined value (number of rotations) (for example, 500).

This makes it possible to keep high the accuracy of color registration control.

Third Embodiment

Next, a description is given of a third embodiment.

The detection error included in a color registration pattern signal changes when the transfer belt 1 is replaced because of the end of its useful service life.

Therefore, according to the third embodiment, the number of recording media printed (the number of rotations of the transfer belt 1) is stored in the storage part 13, and color registration control including calculation of the amount of detection error correction is performed and the number of recording media printed contained in the storage part 13 is reset to zero (0) every time the number of recording media printed reaches a preset value (a preset number of recording media printed) suggesting the end of the useful service time of the transfer belt 1 (for example, 90,000) to cause the transfer belt 1 to be replaced.

This makes it possible to keep high the accuracy of color registration control.

The color registration control may be performed additionally with the same timing as in the second embodiment.

Fourth Embodiment

Figure 11:
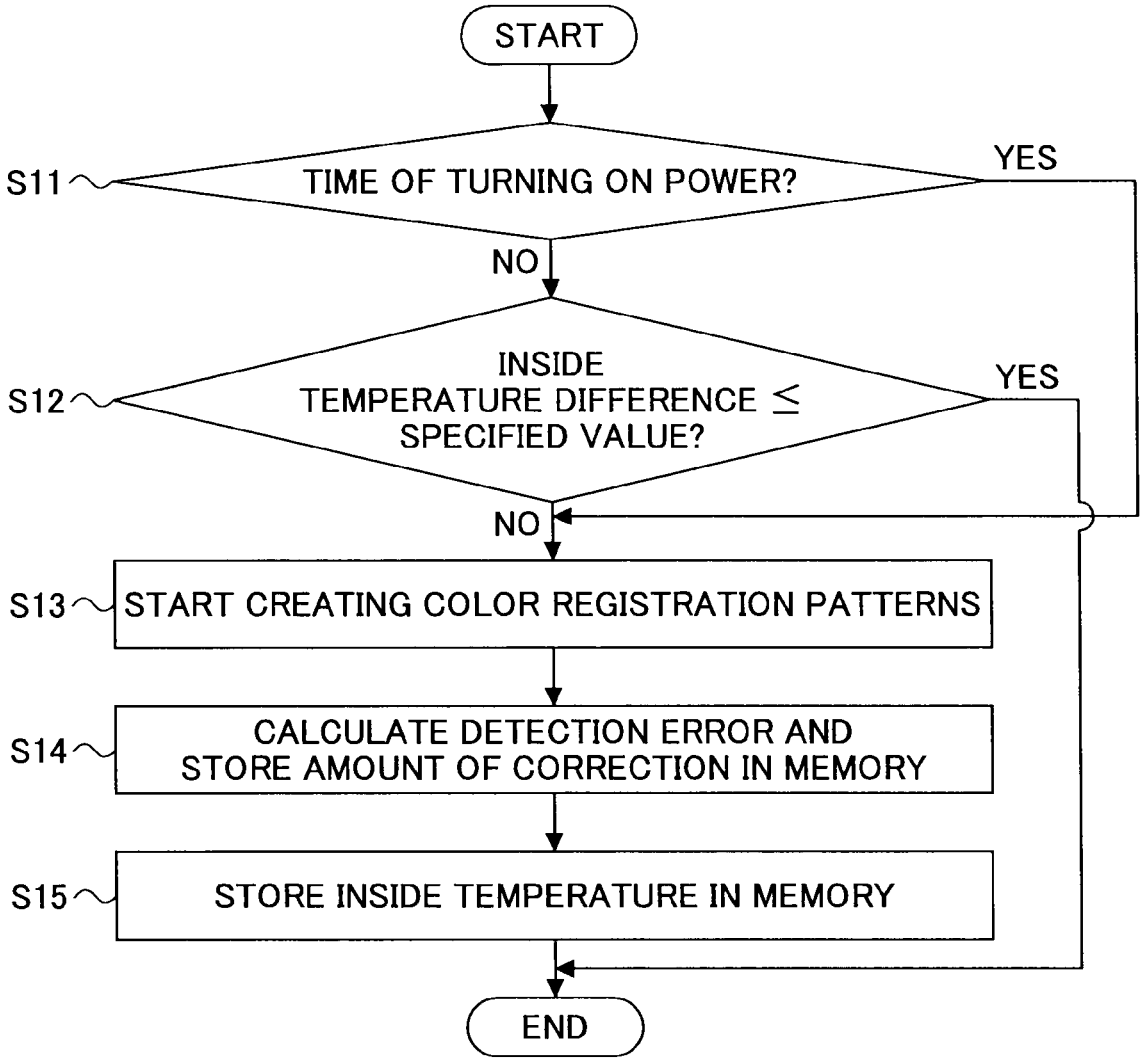
FIG. 11 is a flowchart illustrating color registration control by the control part of FIG. 1 according a fourth embodiment of the image forming apparatus of the present invention.

Next, a description is given, with reference to FIG. 11, of a fourth embodiment.

FIG. 11 is a flowchart illustrating color registration control by the control part 10 of FIG. 1 according to the fourth embodiment. In FIG. 11, the processing of steps S2 through S5 of FIG. 2 are simplified and collectively shown as step S14.

The temperature inside the image forming apparatus (hereinafter also referred to simply as "inside temperature") changes depending on the frequency of its usage, and the change of the inside temperature may cause a change or shift in the position of the pattern detection sensor 7. In this case, the detection error included in a color registration pattern signal may change.

Therefore, according to the fourth embodiment, a description is given of the image forming apparatus where the control part 10 of FIG. 1 periodically performs color registration control (updating of the amount of detection error correction) illustrated in FIG. 11.

First, in step S11, it is determined whether it is a time of turning on power (whether it is immediately after turning on power). If it is a time of turning on power (YES in step S11), the process proceeds to step S13. However, if it is not a time of turning on power (NO in step S11), in step S12, it is determined whether an inside temperature difference is less than or equal to a preset predetermined amount (specified value).

Here, according to this embodiment, the image forming apparatus properly detects the inside temperature using an inside temperature detection sensor, and stores the detected inside temperature in the storage part 13 at the time of calculating the amount of detection error correction (updates the inside temperature stored at the time of previous calculation of the amount of detection error correction).

Then, it is determined whether the inside temperature difference, that is, the difference between a current inside temperature and the inside temperature stored in the storage part 13 at the time of previous calculation of the amount of detection error correction, is less than or equal to a preset predetermined value (specified value).

If the inside temperature difference is less than or equal to a specified value (for example, 5° C.) (YES in step S12), the color registration control of FIG. 11 ends. If the inside temperature difference is more than the specified value (NO in step S12), the process proceeds to step S13. In practice, since the pattern detection sensor 7 (reflection sensor), depending on its type, has an output voltage variation of approximately 0.5%/° C. to 0.6%/° C. because of its relative output-ambient temperature characteristic, the process proceeds to step S13 if there is an output voltage variation of more than 3%, that is, a temperature difference of more than 5° C., compared with the time of previous calculation of the amount of detection error correction.

In step S13, creation of (the images of) color registration patterns of respective colors on the photosensitive bodies 2 is started, controlling the writing unit 3 and the image forming parts, the same as in step S1 of FIG. 2 of the first embodiment.

Next, in step S14, the same processing as steps S3 through S5 of FIG. 2 of the first embodiment is performed, so that the detection error of color registration patterns signals is calculated and is stored in the storage part 13 as the amount of detection error correction.

Thereafter, in step S15, the current inside temperature is also stored in the storage part 13.

This makes it possible to keep high the accuracy of color registration control.

The color registration control may be performed additionally with the same timing as in the second or third embodiment.

Fifth Embodiment

Next, a description is given of a fifth embodiment.

As described above with reference to FIG. 1, the image forming apparatus includes the cleaner part 8 that cleans the peripheral surface of the transfer belt 1.

The cleaner part 8 includes a waste toner delivery operation suspension mechanism for suspending a waste toner delivery operation.

The cleaner part 8 is driven by the same drive source as the transfer belt 1. Therefore, providing a clutch makes it possible for the cleaner part 8 to suspend the waste toner delivery operation in response to a suspension instruction from the control part 10 at the time of detection of color registration patterns by the control part 10 (in particular, at the time of the rotation of the transfer belt 1 in the reverse direction).

This makes it possible to prevent an outflow of toner from the cleaner part 8.

Sixth Embodiment

Next, a description is given of a sixth embodiment.

In the above-described cleaner part 8, the blade for scraping up residual (waste) toner is in contact with the transfer belt 1. Therefore, in the case of creating color registration patterns for one rotation of the transfer belt 1, the cleaner part contact/separation mechanism is used to separate the blade from the transfer belt 1. This makes it possible to create color registration patterns for one rotation of the transfer belt 1 and to perform color registration control with high accuracy.

Seventh Embodiment

Figure 12:
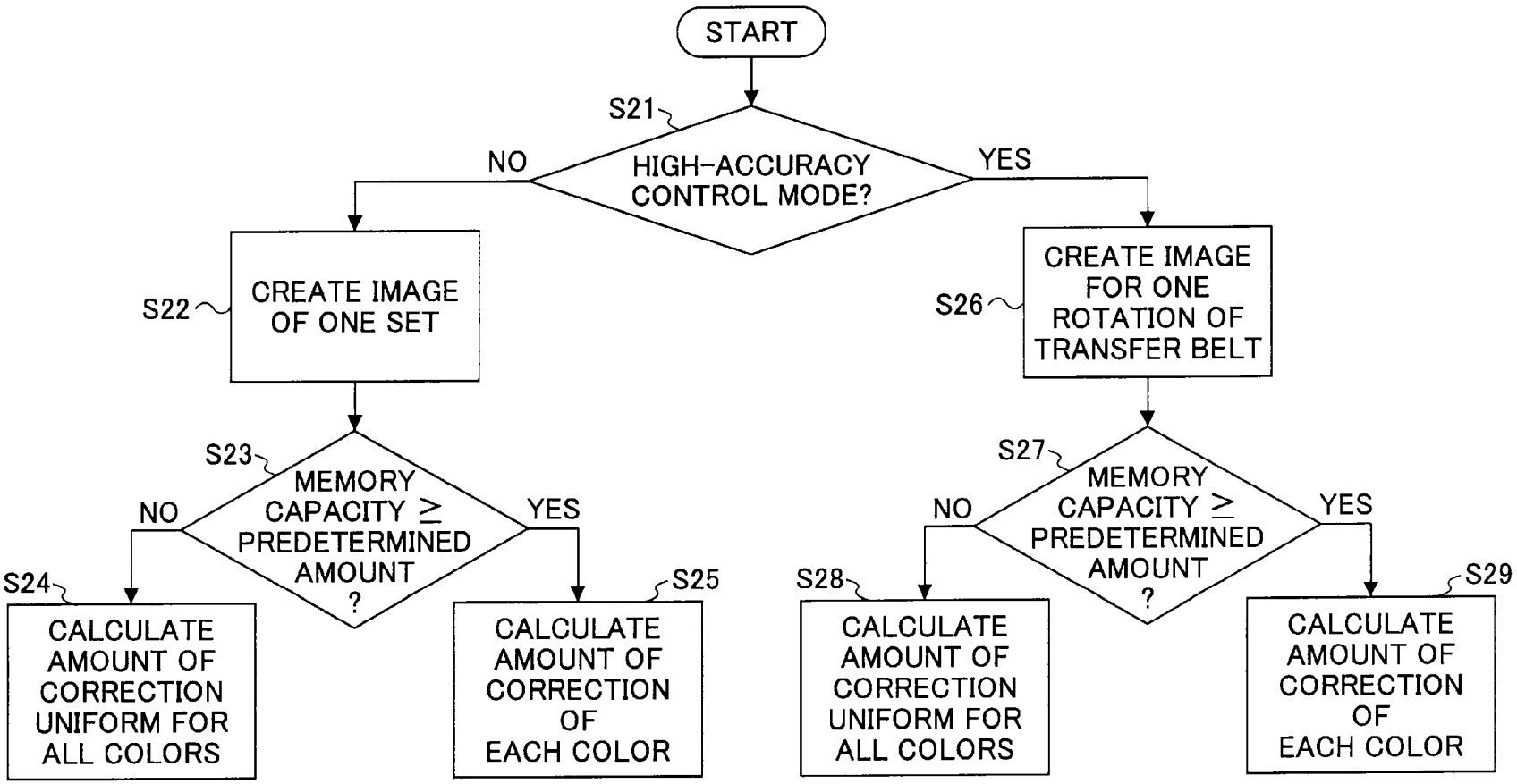
FIG. 12 is a flowchart illustrating processing by the control part of FIG. 1 including creation of color registration patterns and calculation of the amount of detection error correction according to a seventh embodiment of the image forming apparatus of the present invention.

Next, a description is given, with reference to FIG. 12, of a seventh embodiment of the present invention.

FIG. 12 is a flowchart illustrating processing by the control part 10 of FIG. 1 including creation of color registration patterns and calculation of the amount of detection error correction.

This processing is performed in steps S1 through S5 of FIG. 2 or in steps S13 and S14 of FIG. 11.

The control part 10 can select a high-speed control mode or a high-accuracy control mode based on an external operation (such as an operation performed on an operations part [not graphically illustrated]). The high-speed control mode commands color registration control at high speed. The high-accuracy control mode commands color registration control with high accuracy.

Before creation of color registration patterns, in step S21, it is determined whether the selected control mode is a high-accuracy control mode (or a high-speed control mode). If the selected control mode is not a high-accuracy control mode but a high-speed control mode (NO in step S21), the process proceeds to step S22.

In step S22, creation of color registration patterns of respective colors on the photosensitive bodies 2 is started by controlling the writing unit 3 and the image forming parts. In response to completion of the creation of color registration patterns of respective colors, the color registration patterns are transferred onto the transfer belt 1 as illustrated in FIG. 3. As a result, a single set of color registration patterns of all the colors, which is a minimum unit, is created on the transfer belt 1. Therefore, the transfer rollers 4 are moved down by the corresponding transfer belt contact/separation mechanisms so that the photosensitive bodies 2 are separated from the transfer belt 1.

Next, in step S23, the (available) memory capacity of the storage part 13 (nonvolatile memory) of FIG. 1 is checked (determined). If it is determined that the memory capacity is less than a predetermined amount (NO in step S23), in step S24, the amount of detection error correction uniform for all the colors is calculated and stored in the storage part 13. The amount of detection error correction uniform for all the colors corresponds to what is determined by Equation (10) of the first embodiment. If it is determined that the memory capacity is more than or equal to a predetermined amount (YES in step S23), in step S25, the amount of detection error correction of each color is calculated and stored in the storage part 13. The amounts of detection error correction of the colors are determined by Equations (7), (8), and (9), respectively.

On the other hand, if the selected control mode is a high-accuracy control mode (YES in step S21), the processing of step S26 is performed.

That is, the waste toner delivery operation of the cleaner part 8 is suspended, and at the same time, the blade of the cleaner part 8 is separated from the transfer belt 1 using the cleaner part contact/separation mechanism. As a result, it is possible to create color registration patterns for one rotation of the transfer belt 1.

Thereafter, creation of color registration patterns of respective colors on the photosensitive bodies 2 is started by controlling the writing unit 3 and the image forming parts. The same processing as step S22 is repeated until n sets of color registration patterns of all the colors (for one rotation of the transfer belt 1), which are a maximum image-creatable range or a maximum range where images are creatable, are created on the transfer belt 1 (n is an integer greater than zero). Thereafter, the transfer rollers 4 are moved down by the corresponding transfer belt contact/separation mechanisms so that the photosensitive bodies 2 are separated from the transfer belt 1.

After completion of the processing of step S26, in step S27, the (available) memory capacity of the storage part 13 is checked (determined). If it is determined that the memory capacity is less than a predetermined amount (NO in step S27), in step S28, the amount of detection error correction uniform for all the colors is calculated and stored in the storage part 13. If it is determined that the memory capacity is more than or equal to a predetermined amount (YES in step S27), in step S29, the amount of detection error correction of each color is calculated and stored in the storage part 13.

The seventh embodiment produces effects such as those described below as (B1) through (B3).

(B1) A high-speed control mode that commands color registration control at high speed or a high-accuracy control mode that commands color registration control with high accuracy may be selected based on an external operation, and the color registration control may be performed in accordance with the selected control mode. This makes the image forming apparatus more user-friendly.

(B2) In the case of selecting the high-accuracy control mode, the waste toner delivery operation of the cleaner part 8 may be suspended, and the transfer belt 1 and the cleaner part 8 may be separated. This makes it possible to create color registration patterns for one rotation of the transfer belt 1, thus ensuring that the color registration control is performed with high accuracy.

(B3) The amount of detection error correction may be calculated with respect to each color of the color registration patterns created on the transfer belt 1 or a recording medium or the amount of detection error correction common to all the colors may be calculated depending on the (available) memory capacity of the storage part 13. This makes it possible to prevent suspension of color registration control due to insufficient memory capacity.

According to this embodiment, the level of the output signal of the pattern detection sensor 7 (pattern detecting part) may be controlled. Therefore, the color registration control including calculation (updating) of the amount of detection error correction may be performed after the level control. This makes it possible to always perform color registration control with high accuracy.

Further, the above-described color registration control can be executed not only in the case of using a writing apparatus configured to write with four laser light beams but also in the case of using a writing apparatus configured to write with two, three, or more than four laser light beams.

The embodiments of the present invention in which the present invention is applied to an image forming apparatus using a transfer belt are described above. The present invention, however, is not limited to the above-described embodiments, and is also applicable to image forming apparatuses using other endless moving members such as a conveyor belt that conveys a recording medium.

Thus, an image forming apparatus according to one embodiment of the present invention makes it possible to improve the accuracy of color registration on an endless moving member in the case of forming a color image. Therefore, according to one aspect of the present invention, it is possible to provide an image forming apparatus capable of producing high-quality images with stability. Further, according to one aspect of the present invention, the output signal of a pattern detecting part (optical sensor) is controlled. Accordingly, the present invention is applicable to a field where a distance or position is measured using a pattern detecting part.

The present invention is not limited to the specifically disclosed embodiments, and variations and modifications may be made without departing from the scope of the present invention.

The present application is based on Japanese Priority Patent Application No. 2008-051617, filed on Mar. 3, 2008, and Japanese Priority Patent Application No. 2009-047875, filed on Mar. 2, 2009, the entire contents of which are incorporated herein by reference.

What is claimed is:

1. An image forming apparatus configured to form a color image by successively superposing images of respective colors, formed on image carriers of corresponding image forming parts arranged side by side along a rotational direction of a single endless moving member, onto one of the endless moving member and a recording medium conveyed thereby, the image forming apparatus comprising:

a pattern image creating part configured to cause a color registration pattern to be created on the one of the endless moving member and the recording medium;

a color registration pattern detecting part configured to obtain a color registration pattern signal by detecting the created color registration pattern;

an image formation timing varying part configured to change image formation timing in the image forming parts based on the obtained color registration pattern signal; and a control part configured to cause the endless moving member to rotate in a forward direction and a reverse direction after the creation of the color registration pattern, wherein the color registration pattern detecting part is configured to obtain the color registration pattern signal by detecting the color registration pattern during each of the forward rotation and the reverse rotation of the endless moving member.

2. The image forming apparatus as claimed in claim 1, wherein:

the color registration pattern signal comprises a forward color registration pattern signal obtained by detecting the color registration pattern during the forward rotation of the endless moving member and a reverse color registration pattern signal obtained by detecting the color registration pattern during the reverse rotation of the endless moving member; and the image formation timing varying part is configured to change the image formation timing in the image forming parts based on a value of a difference between the forward color registration pattern signal and the reverse color registration pattern signal.

3. The image forming apparatus as claimed in claim 1, further comprising:

a cleaner part configured to clean a peripheral surface of the endless moving member, the cleaner part including a waste toner delivery mechanism for suspending a waste toner delivery operation, wherein the control part is configured to cause the waste toner delivery mechanism to suspend the waste toner delivery operation in detecting the color registration pattern.

4. The image forming apparatus as claimed in claim 1, further comprising:

a control mode selecting part configured to select one of a high-speed control mode and a high-accuracy control mode based on an external operation, the high-speed control mode commanding a color registration control at high speed and the high-accuracy control mode commanding the color registration control with high accuracy, wherein the pattern creating part is configured to cause the color registration pattern to be created in a minimum unit on the one of the endless moving member and the recording medium in response to the control mode selecting part selecting the high-speed control mode, and to cause the color registration pattern to be created over a maximum image-creatable range on the one of the endless moving member and the recording medium in response to the control mode selecting part selecting the high-accuracy control mode.

5. The image forming apparatus as claimed in claim 1, further comprising:

a rotation number storage part configured to store a number of rotations of the endless moving member, wherein the pattern creating part is configured to cause the color registration pattern to be created every time the number of rotations of the endless moving member reaches a preset predetermined number of rotations.

6. The image forming apparatus as claimed in claim 1, further comprising:

a storage part configured to store a detection error calculated based on the color registration pattern signal, wherein the color registration pattern detecting part is configured to obtain an additional color registration pattern signal by detecting the color registration pattern during an additional forward rotation of the endless moving member, and the image formation timing varying part is configured to change the image formation timing in the image forming parts based on the additional color registration pattern signal obtained by the color registration pattern detecting part and the detection error stored in the storage part.

7. The image forming apparatus as claimed in claim 6, wherein the image formation timing varying part is configured to update the detection error stored in the storage part every time the color registration pattern is created.

8. The image forming apparatus as claimed in claim 6, further comprising:

an inside temperature detecting part configured to detect a temperature inside the image forming apparatus; and an inside temperature storage part configured to store the detected temperature, wherein the image formation timing varying part is configured to update the detection error stored in the storage part in response to a difference between the detected temperature of a current detection and the detected temperature of a previous detection stored in the inside temperature storage part reaching a preset predetermined value.

9. The image forming apparatus as claimed in claim 6, further comprising:

a level control part configured to control a level of an output signal of the color registration pattern detecting part, wherein the image formation timing varying part is configured to update the detection error stored in the storage part in response to the level control part controlling the level of the output signal of the color registration pattern detecting part.

* * * * *